US005295632A

United States Patent [19]

Zink et al.

[11] Patent Number: 5,295,632

[45] Date of Patent: Mar. 22, 1994

[54] TOTE BOX WITH SELF LOCKING TOP RAIL

[75] Inventors: Robert M. Zink, Grand Haven; Judson A. Bradford, Holland; Donald J. Bazany, Grand Haven, all of Mich.

[73] Assignee: Bradford Company, Holland, Mich.

[21] Appl. No.: 992,562

[22] Filed: Dec. 18, 1992

[51] Int. Cl.[5] ..... B65D 5/44

[52] U.S. Cl. ..... 229/198; 229/117.16; 229/198.1; 229/199; 229/918; 229/919

[58] Field of Search ..... 229/23 R, 117.16, 117.17, 229/117.24, 198.198.1, 199, 915, 918, 919, DIG. 11; 206/509, 512

[56] References Cited

U.S. PATENT DOCUMENTS

| | | | |
|---|---|---|---|
| 1,241,633 | 10/1917 | Johnson . | |
| 1,682,028 | 8/1928 | Young . | |
| 2,191,291 | 2/1940 | Smith . | |
| 2,225,958 | 12/1940 | Mandel | 229/915 |
| 2,304,853 | 12/1942 | Shaw . | |
| 2,347,725 | 5/1944 | Zalkind . | |
| 2,941,710 | 6/1960 | Smith et al. | 229/199 |
| 2,947,462 | 8/1960 | Bostock . | |
| 2,954,914 | 10/1960 | Herlihy | 229/199 |
| 2,961,139 | 11/1960 | Nobili | 229/918 |
| 3,226,008 | 12/1965 | Chiorri | 229/198 |
| 3,331,527 | 7/1967 | Kaas et al. . | |
| 3,512,696 | 5/1970 | Ebert . | |
| 3,622,037 | 11/1971 | Gildart . | |
| 3,647,101 | 3/1972 | Hensch et al. . | |
| 3,659,774 | 5/1972 | Mielke . | |
| 3,687,168 | 8/1972 | Sherman et al. . | |
| 3,797,727 | 3/1974 | Downing et al. . | |
| 4,068,794 | 1/1978 | Lawrence | 229/915 |
| 4,095,719 | 6/1978 | Wolf . | |
| 4,172,623 | 10/1979 | Anderson . | |
| 4,210,274 | 7/1980 | Leonard | 229/918 |
| 4,503,973 | 3/1985 | Andersson . | |
| 4,572,368 | 2/1986 | Miller et al. . | |
| 4,619,371 | 10/1986 | Rehrig . | |
| 4,624,380 | 11/1986 | Wernette . | |
| 4,693,387 | 9/1987 | Stonier . | |
| 4,787,515 | 11/1988 | Stoll | 206/509 |
| 4,848,580 | 7/1989 | Wise . | |
| 4,971,201 | 11/1990 | Sathre . | |
| 5,033,669 | 7/1923 | Federico . | |
| 5,037,027 | 8/1991 | Nichols . | |
| 5,074,461 | 12/1991 | Parker et al. | 229/117.16 |

FOREIGN PATENT DOCUMENTS

| | | | |
|---|---|---|---|
| 1321584 | of 1962 | France . | |
| 53167 | 9/1942 | Netherlands | 229/DIG. 11 |
| 6612391 | of 1968 | Netherlands . | |

*Primary Examiner*—Gary E. Elkins

*Attorney, Agent, or Firm*—Wood, Herron & Evans

[57] ABSTRACT

An improved tote box construction is disclosed which incorporates a unitary top rail which can be secured along the top edge of the erected walls of the tote box without the benefit of any mechanical fasteners such as rivets or the like. The unitary top rail is secured onto the tote box by a hook on the bottom edge of a channel side wall which engages downwardly folded tabs on the top edge of the walls of the tote box. The unitary top rail has a vertical lip which facilitates the stacking of multiple tote boxes according to the present invention.

34 Claims, 4 Drawing Sheets

TOTE BOX WITH SELF LOCKING TOP RAIL

BACKGROUND OF THE INVENTION

This invention relates to tote boxes and more particularly to tote boxes made from foldable box blanks and having self locking top rails to hold the blanks in an erected, assembled relationship.

Containers which are returnable/reusable are useful for the transportation, storage, and display of goods in commerce. Such containers, commonly called tote boxes, must be of sufficiently rigid construction to enable safe and damage free transport and storage of goods contained therein. These tote boxes are frequently designed so as to be stacked or mounted in a nesting relation for convenient transportation or storage of the tote boxes. In order to be stackable, the upper edge of the tote box is typically reinforced with a top rail or rim member which is adapted to receive another tote box stacked thereupon.

It is conventional to use a variety of materials for the construction of such tote boxes. Such materials typically consist of corrugated paperboard, corrugated plastic sheet, sheet metal and other such materials which are not sufficiently rigid to support a number of filled tote boxes in stacked relation. Therefore, it is also conventional to reinforce the corners of the tote boxes with structural supports so that a lower tote box of a stack of tote boxes can adequately support the load of the upper tote boxes and goods therein without deformation, possibly resulting in damage to the goods contained therein.

Typically these tote box corner supports and top rails require additional fasteners such as rivets, staples, screws or the like to secure the top rail and the corner support to the box itself. These fasteners add material costs and manufacturing steps to the construction of the tote box thereby resulting in an expensive and difficult to assemble tote box.

Accordingly, it is a primary objective of the present invention to provide a tote box made from a novel box blank and top rail which facilitates assembly of the tote box without any fasteners and with a minimum of assembly steps and space.

Another objective of this invention has been to provide such a tote box which facilitates the stacking of additional tote boxes thereon without deformation of the tote box.

It is an additional objective of the present invention to provide a tote box corner support which can be incorporated into the tote box corner with a minimum of assembly steps or operations, and which does not require additional fasteners to secure the corner support to the tote box.

A further object of the present invention has been to reduce the amount of time and expense required to assemble a top edge reinforced tote box.

SUMMARY OF THE INVENTION

The present invention is directed to a tote box which is assembled from a die cut box blank and top edge rim support. When folded into the appropriate shape, the die cut box blank results in a bottom, two end walls, and two side walls over the top edge of which the top edge rim support is assembled. The erected end walls preferably have holes into which are inserted reinforcing hand holds to aid in manual handling of a loaded tote box.

To hold the erected box blank in an assembled relationship and to reinforce the top edge of the tote box, a channel shaped unitary top rail extends around the top edge of the tote box. This top rail has a downwardly open channel formed therein which is at a minimum approximately twice, and preferably three times, the thickness of the box blank. When the downwardly open channel of the top rail is pushed down over the top edge of the erected box blank, the channel fits over a double thickness of the tote box formed from tabs or flaps extending from the side and end walls of the box blank. The top rail is locked onto the top edge of the box as the result of an inwardly extending hook on the bottom of the outermost channel wall which snaps beneath downwardly folded tabs on the top edge of the walls of the tote box.

The unitary top rail is manufactured from a single piece of extruded plastic or aluminum from which four corner notches are removed by notching dies. This single long extrusion is folded to 90° at each corner notch and the ends are welded together at the midpoint of one side to form the top rail assembly which can then simply be snapped over the erected tote box. The hook on the downwardly open channel engages the downwardly folded tab on the side or end walls thereby securing the top rail onto the top edge of the tote box without the need for further fasteners such as screws, rivets, or staples. The top rail has a vertical lip which extends around the periphery of the top rail. The lip enables nested stacking of additional tote boxes which fit within the lip on the top rail.

Structural corner supports reside within each corner of the tote box to stiffen the tote box corners and to provide a load path for the weight of the stacked tote boxes and their contents to be distributed downwardly from the top rail of the tote box to the lower corners of the tote box and outward to the supporting surface. The present invention includes two embodiments of structural corners. The first, a corner enhancer, is inserted into each inside corner of the box such that one leg of the corner enhancer is sandwiched between the end wall and a flap which extends from the side wall. A second leg of the corner enhancer resides against the inside surface of the side wall. Once the box blank has been folded and the corner enhancers have been inserted within the corners of the box, the top rail can then be snapped in place on the top edge of the tote box. Since one leg of each corner enhancer is securely sandwiched between a box end wall and a flap, there is no need to apply mechanical fasteners to secure the corner enhancer angle in place.

In the second embodiment of the structural corner, extruded corner angles having a pair of open channel legs are used to form the corners of the tote box and to provide a load path for the weight of the stacked tote boxes and their contents to be distributed downwardly, and thereby provide structural integrity to the tote box and prevent side and end wall deformation. Each lateral edge of the side and end walls of the box blank has a flap which extends therefrom and is folded back onto the respective wall. The corner angle is then either pushed down into a corner of the tote box between the folded lateral edges of a side and end wall or the folded side and end walls are snapped into the channels of the corner angle. A first channel leg of the corner angle fits over the double thickness of the side wall and flap folded thereon, and a second leg of the corner angle fits over the end wall and flap folded thereon. The corner angle is secured to the corner of the tote box as the result of an inwardly extending hook on an edge of the innermost side of each channel of the corner angle. The hook fits over the folded flaps on each wall of the tote box. Since each channel leg of the corner angle has an inwardly extending hook which secures the corner angle at the intersection of the side and end walls of the tote box, there is no need for mechanical fasteners in erecting this embodiment of the tote box although a single rivet or other fastener could be used, in the absence of a top rail, to secure this embodiment of the structural corner against inadvertent removal.

One advantage of each embodiment of the present invention is that the tote box can be assembled rapidly without the need for intermediate fastener joining steps and without the need for multiple rivets or fasteners such as have been conventional in prior art tote boxes as, for example, in the tote box disclosed in the assignee's own earlier U.S. Pat. No. 5,037,027. Another advantage of the present invention is that the stackable tote box may be constructed more quickly and less expensively than is presently possible in competitive type tote boxes.

BRIEF DESCRIPTION OF THE DRAWINGS

The objectives and features of the present invention will become more readily apparent when the following Detailed Description is taken in conjunction with the accompanying drawings in which.

DETAILED DESCRIPTION OF THE INVENTION

Figure 1:
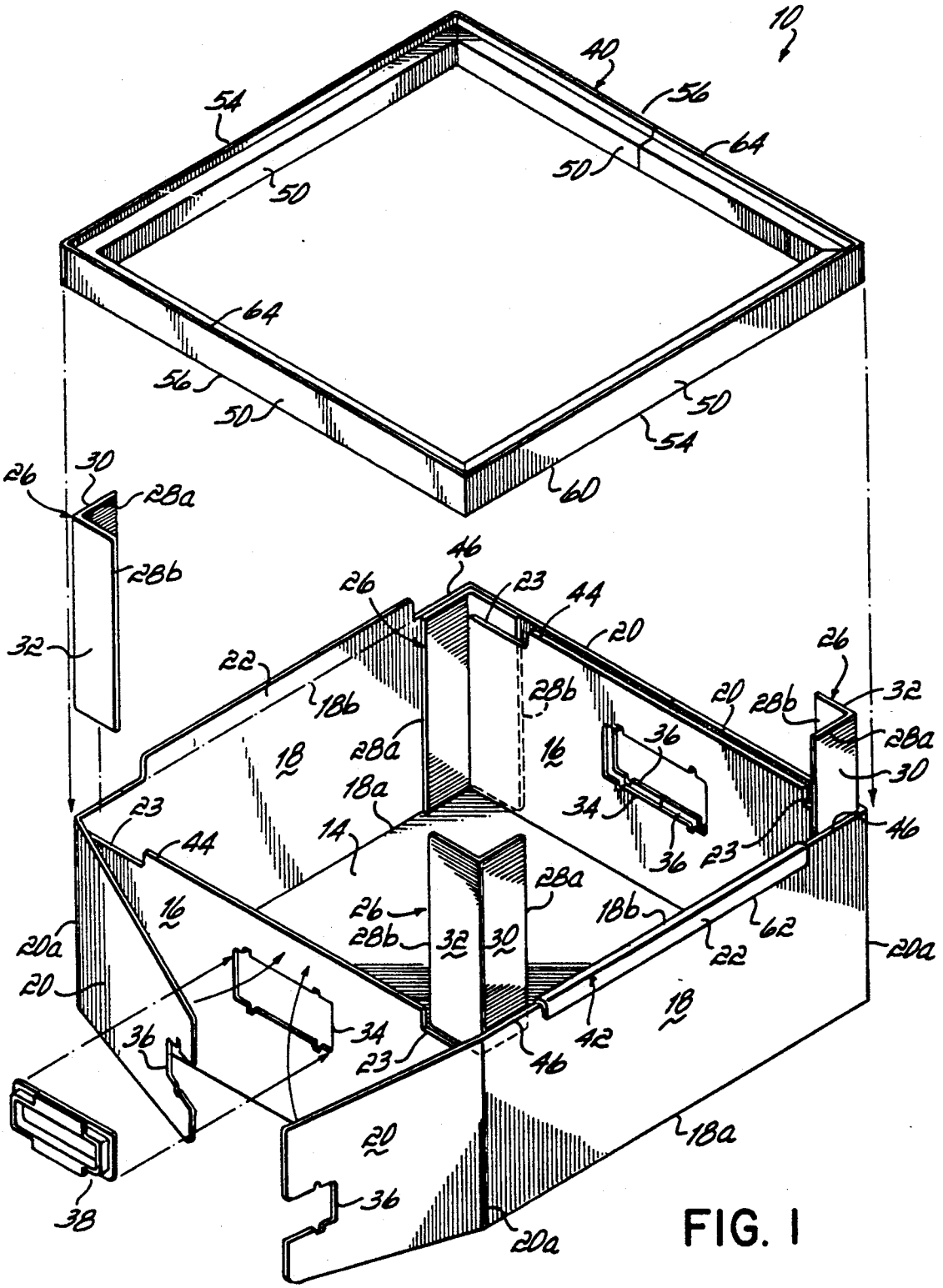
FIG. 1 is an exploded perspective view of a preferred embodiment of the tote box of the present invention.
Figure 2:
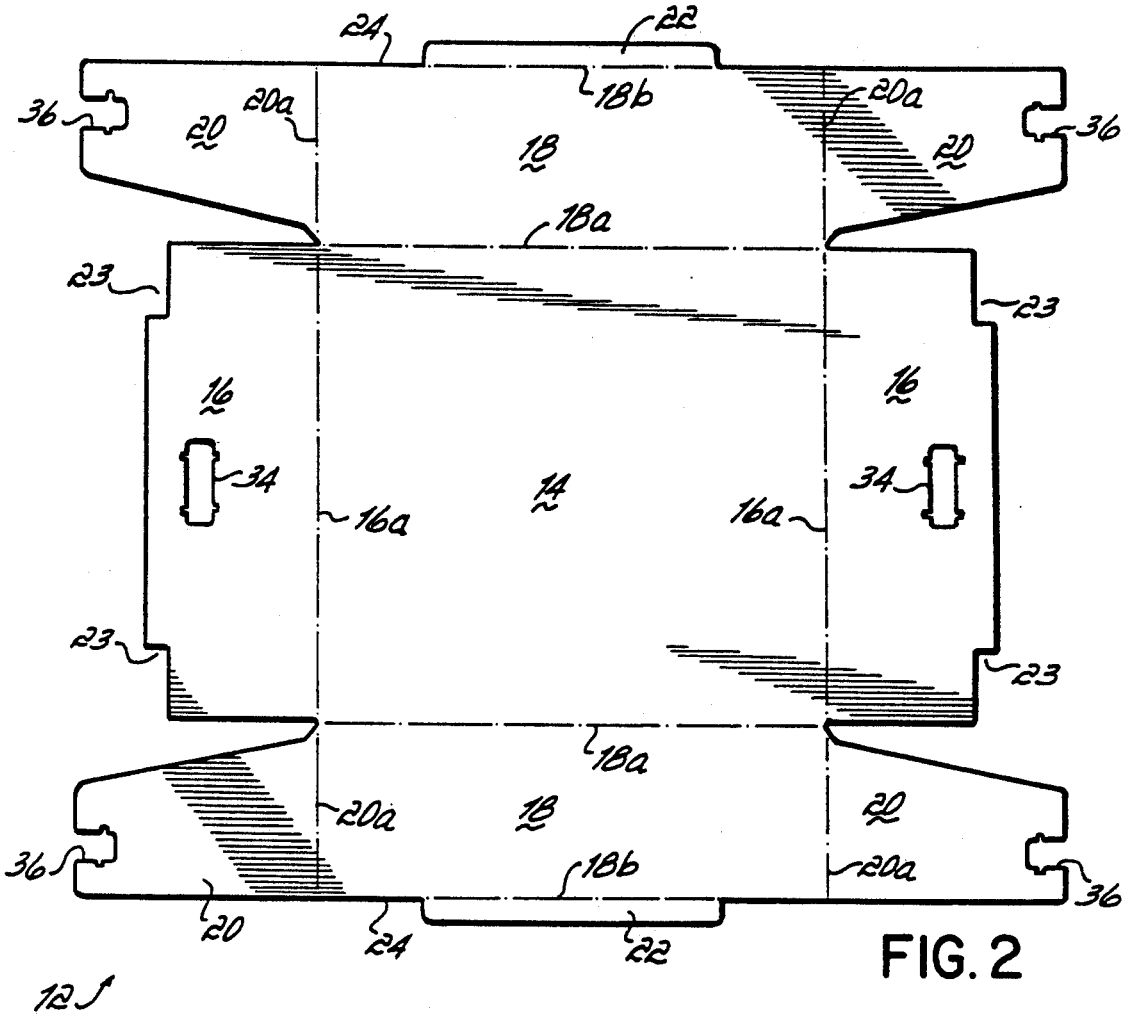
FIG. 2 is a top plan view of a box blank used to form the tote box of FIG. 1.

Referring to FIG. 1, a first preferred embodiment of a tote box 10 according to the present invention is shown. The tote box 10 is assembled from a uniform thickness box blank 12 (FIG. 2) which is die cut or otherwise precut from, preferably, corrugated plastic sheet. The box blank 12 has a bottom 14, two end walls 16 connected to the bottom 14 by fold lines 16*a*, two side walls 18 connected to the bottom 14 by fold lines 18*a*, and end flaps 20 which are lateral extensions of the side walls 18 and are connected thereto by fold lines 20*a*. Notches 23 are provided in the uppermost corners of each end wall 16 to facilitate the construction of the tote box 10 as described later in this disclosure. The box blank 12 also includes side tabs 22 which are extensions on an uppermost edge 24 of the erected side wall 18 and are connected to the top edge of the side walls 18 by fold lines 18*b*. The side tabs 22 are downwardly folded onto the side walls 18 as shown in FIG. 1.

Four corner enhancers 26 are used in this preferred embodiment of the present invention tote box. These corner enhancers 26 are preferably made of plastic or aluminum. Each corner enhancer 26 has two equal length legs 28*a*, 28*b* which are substantially normal to one another and are of a height approximately equal to the height of the side and end walls.

To assemble the tote box 10 of this preferred embodiment, the side walls 18 are first folded upward. Next, the end walls 16 are folded upward and the end flap 20 is then folded inward. The end holes 34 are generally rectangular and each end flap cutout 36 is essentially one half of an end hole 34 so that when complementing end flaps 20 are folded against the end wall 16 a hole identical in size to the end hole 34 is generated whereupon the hand hold 38, preferably fabricated from plastic or aluminum, may be inserted therein.

Once the side walls 18 and the end walls 16 are erected, the corner enhancers 26 are inserted into each corner of the erected tote box such that an outside surface 30 of the first corner enhancer leg 28*a* is parallel to the side wall 18 and adjacent to the inside surface of that side wall. An inside surface 26 of the second corner enhancer leg 28*b* is parallel to the erected end wall 16 and is adjacent to the outside surface of that end wall. The corner enhancer is thereby sandwiched with the second corner enhancer leg 28*b* between the end wall 16 and the end flap 20.

Figure 4:
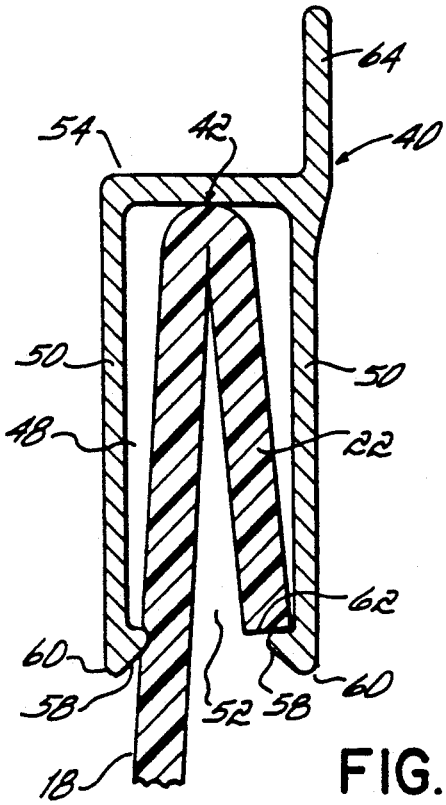
FIG. 4 is a cross sectional view of a top rail and tote box wall taken on line 4—4 of FIG. 3.

Once the side walls 18 and end walls 16 of the tote box 10 are erected, the hand holds 38 inserted, and the corner enhancers 26 positioned, the final step in the assembly of the tote box 10 can be accomplished by snapping in place the top rail 40 on a top edge 42 of the erected box 10. The top edge 42 is formed from a top edge of each end wall 44 and each side wall 46. Prior to securing the top rail 40, the side tabs 22 must be folded downward upon the side walls 18. Once the side tabs 22 are folded, the unitary top rail 40 can be snapped onto the top edge 42 of the erected tote box 10. The top rail 40 has a downwardly open channel 48 which is formed by two spaced channel side walls 50 as shown in FIG. 4. The channel 48 has an opening 52 of a width at least twice the thickness of the box blank 12 and in the preferred embodiment, approximately three times the thickness of the box blank 12. The channel opening 52 is of sufficient width to accommodate the side wall 18 and side tab 22 folded thereon in a first section 54 of the top rail, and the end wall 16 and end flap 20 folded thereon in a second section 56 of the top rail, all as shown in FIGS. 1 and 4. The notches 23 permit the channel opening 52 to conveniently fit over the end flap 20 and the corner enhancer leg 28*b* in this region of the erected tote box 10 without the interference of the end wall 16.

An inwardly extending hook 58 is provided on a bottom edge 60 of each channel wall 50 in the preferred embodiment. When the top rail 40 is snapped onto the erected tote box 10, one of the hooks 58 engages a bottom edge 62 of the downwardly folded side tab 22 thereby securing the top rail 40 on the erected tote box 10 as shown in FIG. 4. Once the top rail 40 is pressed onto the top edge 42 of the tote box 10 and one of the hooks 58 engages the downwardly folded side tabs 22, the tote box 10 of this preferred embodiment is erected without the benefit of mechanical fasteners, rivets, staples, or the like. While the tab 22 is illustrated in FIG. 4 as being folded downwardly on the outside of the side wall 18, it could just as well be folded downwardly on the inside of this same wall.

The top rail 40 according to the present invention has a vertically extending lip 64 on an outside upper edge thereof. The lip 64 facilitates the stacking of a second tote box in a nested relationship upon a tote box 10 of the present invention. The weight of the tote box stacked on the top rail 40 is distributed around the top rail 40 and supported by the corner enhancers 26 of this embodiment of the present invention.

Figure 5:
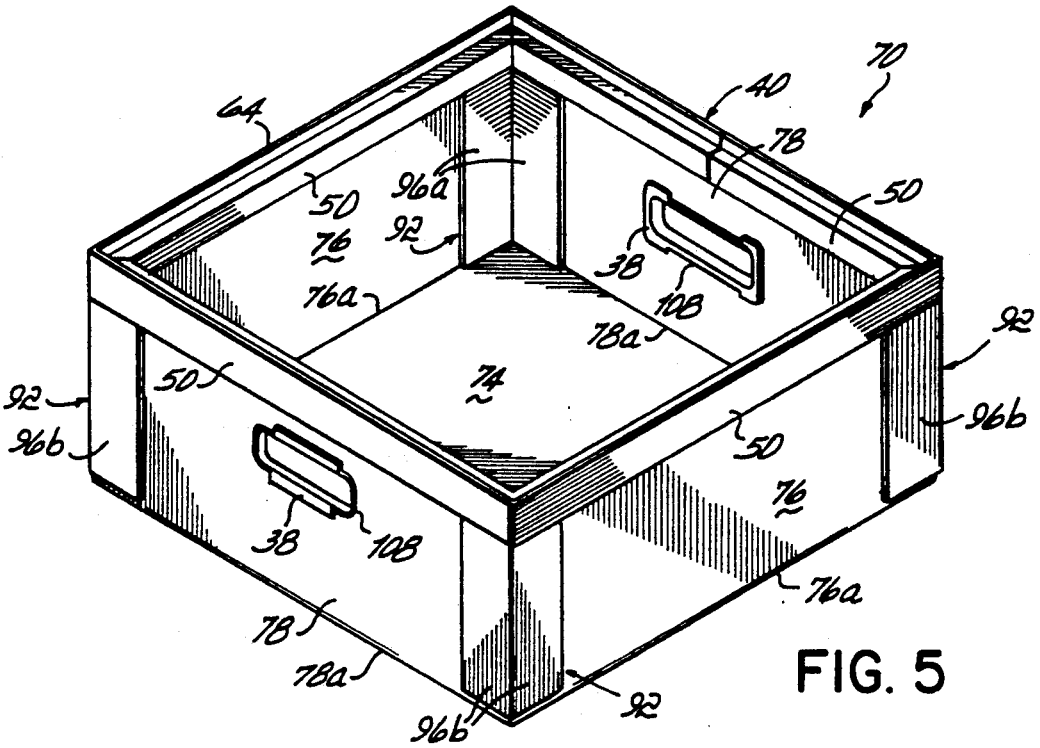
FIG. 5 is a perspective view of a second preferred embodiment of the invention of the application.
Figure 3:
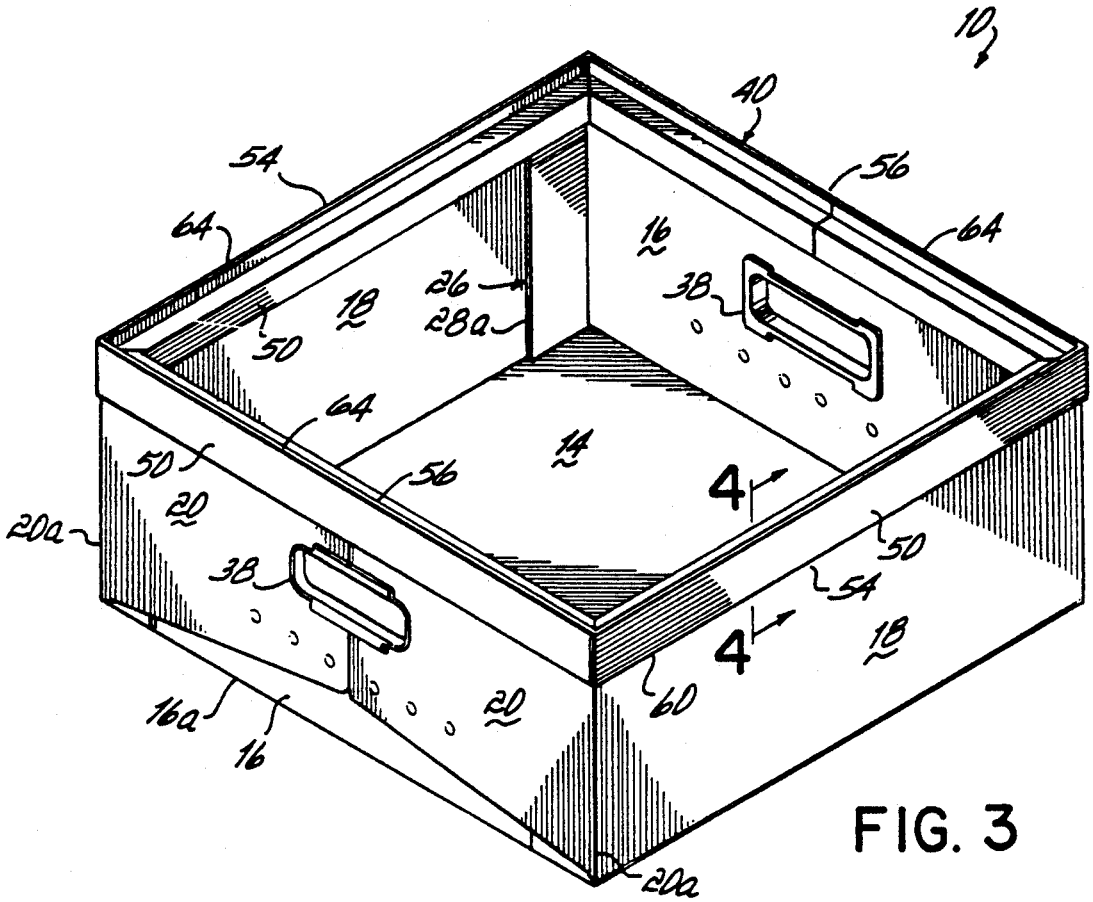
FIG. 3 is a perspective view of the assembled tote box of FIG. 1.
Figure 6:
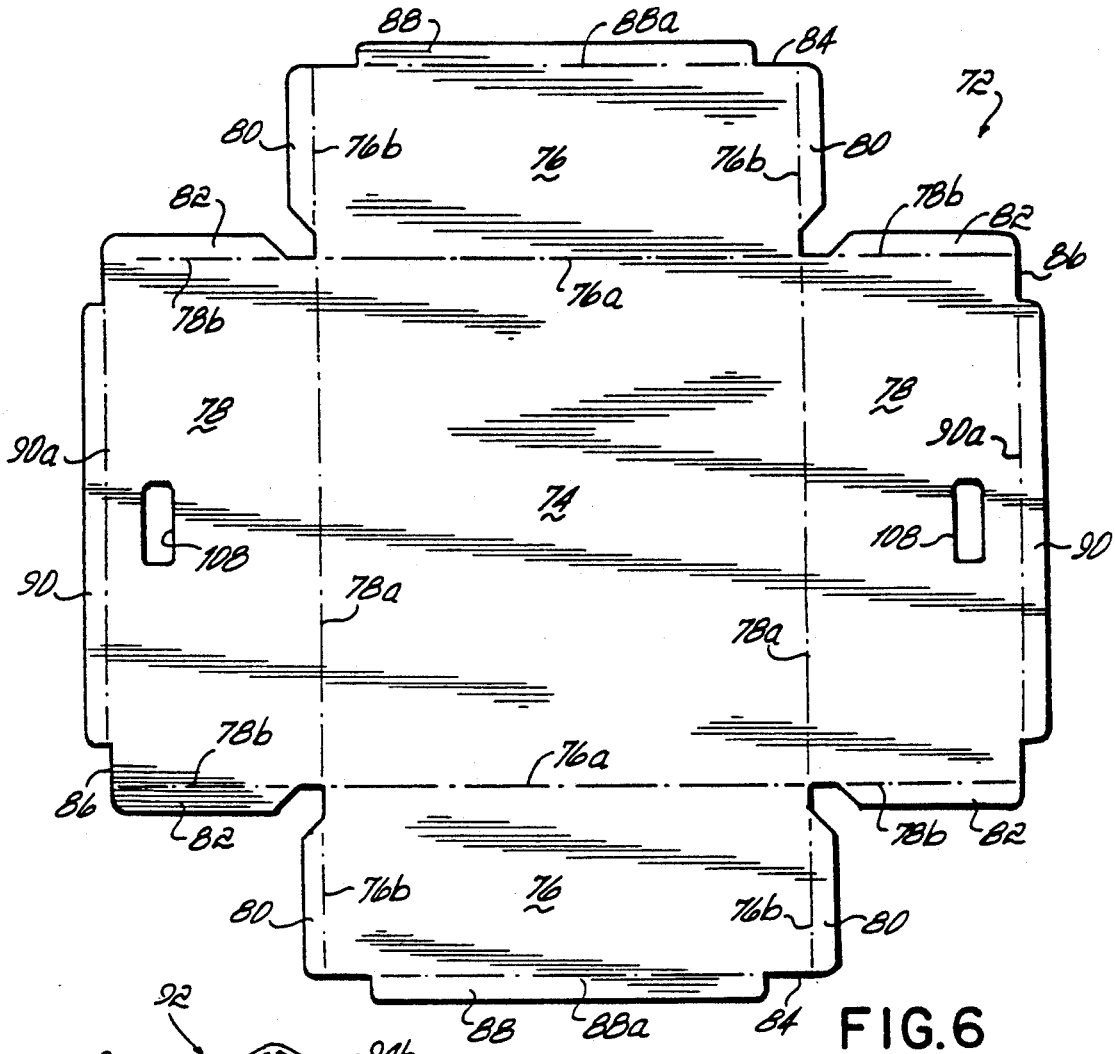
FIG. 6 is a top plan view of a box blank used to form the second preferred embodiment of the tote box of the present invention.

A second preferred embodiment of the tote box 40 according to the present invention is illustrated in FIG. 5. The second embodiment is formed from a uniform thickness box blank 72 illustrated in FIG. 6. This second preferred embodiment of the tote box blank 72 is preferably die cut or otherwise precut from corrugated plastic sheet. The box blank 72 has a bottom 74, two side walls 76 connected to the bottom 74 by fold lines 76*a*, two end walls 78 connected to the bottom 74 by fold lines 78*a*, side flaps 80 which are lateral extensions of the side walls 76 and connected to the bottom 74 by fold lines 76*b*, and end flaps 82 which are lateral extensions of the end walls 78 and connected thereto by fold lines 78*b*. Attached on an upper edge of each erected side wall 76 and each erected end wall 78 are side tabs 88 connected to the side walls 76 by fold lines 88*a* and end tabs 90 connected to the end walls 78 by fold lines 90*a*.

Four corner angles 92 are used in the construction of the second preferred embodiment of the tote box 70. Corner angles 92 are preferably made of plastic or aluminum. Each corner angle 92 has two approximately equal length channel legs 94*a*, 94*b* which are substantially normal to one another. Each channel leg has a pair of spaced channel walls 96*a*, 96*b* which define a channel opening 98*a*, 98*b* at least twice and preferably approximately three times the width of the thickness of the box blank 72. On a lateral edge of at least one of the channel walls 96*a*, 96*b* of each channel leg 94*a*, 94*b* is a hook 100*a*, 100*b* which projects into the channel opening 98*a*, 98*b*. In the preferred embodiment, the hook 100*a*, 100*b* is on a channel wall 96*a* adjacent the inside surface of the side wall 76 or end wall 78.

Figure 7:
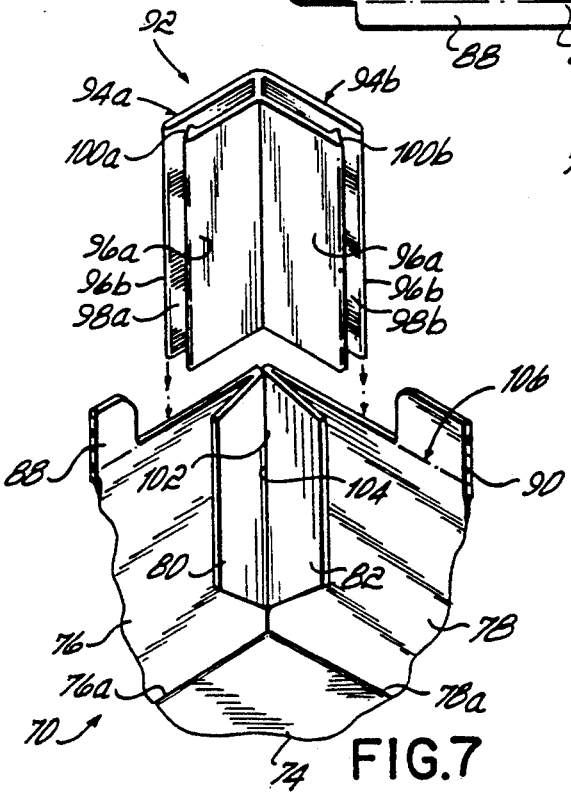
FIG. 7 is an exploded perspective view of the corner angle used in constructing the second preferred embodiment of the tote box of the present invention.
Figure 8:
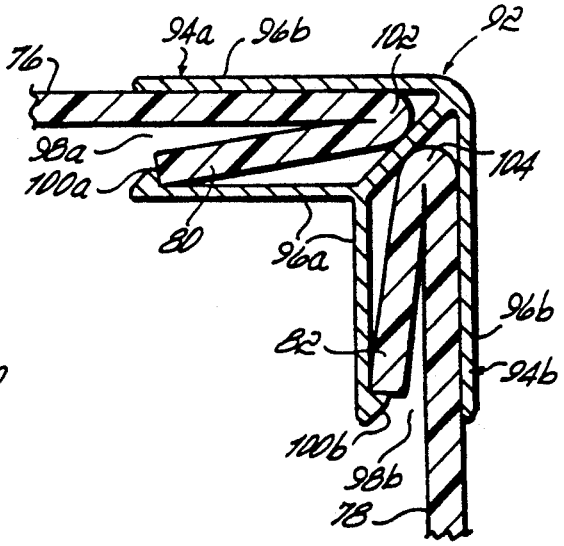
FIG. 8 is a cross sectional view of the corner angle, side wall, and end wall of the second embodiment illustrated in FIG. 5.

To assemble the second preferred embodiment of the tote box 70 according to the present invention, the end walls 78 are first folded upward. Then, the end flaps 82 are folded onto the inside surface of their respective end walls 78. Next, the side flaps are folded onto the inside surface of their respective side walls 76 and the side walls 76 are then folded upward. Once the side walls 76 and end walls 78 are erected in a vertical configuration and the side flaps 80 and end flaps 82 have been folded, the corner angles 92 are slid downwardly in place onto each of the corners of the erected box or snap fit onto those corners. Corner angles 92 are slid onto each corner of the erected tote box 70 as shown in FIG. 7 such that one channel leg 94*a* encompasses a side wall lateral edge 102 formed by the side flap 80 folded thereon, and a second channel leg 94*b* encompasses an end wall 104 lateral edge formed by the end flap 82 folded thereon. Once the corner angle 92 is in place the hook 100 on the inside channel wall 96*a* engages the folded end flap 82 and side flap 80, thereby securing the end walls 74 and side walls 26 in the erected tote box 70 configuration.

After all four corner angles 92 are inserted into the four corners of the erected tote box 70, each side tab 88 and each end tab 90 can be folded downward onto the respective side wall 76 and end wall 78. Then, the unitary top rail 40 according to the present invention which was previously described in relation to the first preferred embodiment can be slid over a top edge 106 of the erected tote box 70 formed by the uppermost edges of the side walls 84 and end walls 86. To complete the construction of the tote box 70 of this preferred embodiment, hand holds 38 are inserted into holes 108 in each end wall 78. Thusly constructed, a tote box 70 according to the present invention is provided without the benefit of mechanical fasteners for securing the unitary top rail 40, corner angles 92, or hand holds 38 onto the tote box 70.

Depending on the application and utility of the tote box 70, corner angles 92 employed in the second preferred embodiment of the present invention may be utilized without the benefit of the unitary top rail 40. However, failure to include unitary top rail 40 in the construction of the tote box would prevent stacking of a second tote box in the convenient nested relationship facilitated by the unitary top rail 40 and the vertical lip 64 according to the present invention.

From the above disclosure of the general principles of the present invention and the preceding detailed description of the preferred embodiments, those skilled in the art will readily comprehend the various modifications to which the present invention is susceptible. Therefore, we desire to be limited only by the scope of the following claims and equivalents thereof:

We claim:

1. A tote box with self-locking top rail comprising:

a box formed from a uniform thickness foldable box blank and having a bottom, two upstanding end walls, two upstanding side walls, and four end flaps which are extensions of said side walls, said side walls and end walls having upper edges which form a top edge of said box, said side walls having tabs on said upper edges thereof which are downwardly folded on said side walls; and a unitary top rail extending around the top edge of said box, said top rail having a downwardly open channel formed between a pair of channel side walls, said channel being fitted over said upper edge of each said side wall, each said end wall, and each of said end flaps, said open channel having a width of approximately twice the thickness of said box blank so as to fit over said end walls and said end flaps and said side walls and said downwardly folded tabs, said open channel having at least one inwardly extending hook on a bottom edge of at least one of said channel side walls, each said hook engaging one of said tabs and locking said top rail onto said top edge of said erected end and side walls.

2. A tote box of claim 1 further comprising:

four corner enhancers, one of which resides in each inside corner of said box such that a first leg of each said corner enhancer is sandwiched between each said end wall and said end flaps and a second leg of each said corner enhancer resides against an inside surface of said side wall.

3. A tote box of claim 1 further comprising:

four side flaps which are extensions of said end walls, each said side flap being attached to a lateral edge of one of said end walls; and four corner angles, one of which is located at each corner of said box, each said corner angle having first and second open leg channels formed between a pair of leg channel side walls, said first leg channel being fitted onto a lateral edge of one of said side walls and said second leg channel being fitted onto said lateral edge of an adjacent said end wall, each said side wall lateral edge being formed by folding said side flap onto said end wall and each said end wall lateral edge being formed by folding said end flap onto said side wall, each said leg channel having a width of approximately twice the thickness of said box blank so that said first leg channel fits onto one of said side wall lateral edges and said second leg channel fits onto said adjacent end wall lateral edge, each of said second and first leg channels having an inwardly extending hook on an edge of at least one of said leg channel side walls for engaging said end flap and said side flap, respectively, said corner angles erecting said end and side walls by having said one side wall lateral edge and said adjacent end wall lateral edge fitted within said first and second leg channels, respectively, to thereby maintain said one side wall and said adjacent end wall generally perpendicular to said bottom.

4. A tote box of claim 1 wherein said foldable box blank is made of corrugated plastic sheet.

5. A tote box of claim 2 wherein said corner enhancers and said top rail are each extruded from a material of at least one of a group consisting of plastic and aluminum.

6. A tote box of claim 3 wherein said corner angles and said top rail are each extruded from a material of at least one of a group consisting of plastic and aluminum.

7. A tote box of claim 1 wherein said top rail has a vertical lip on an outside upper edge thereof for facilitating stacking of a second tote box on top of said tote box.

8. A tote box of claim 1 further comprising:

hand holds which are received into holes in said erected end walls.

9. A tote box with self-locking top rail comprising:

a box formed from a uniform thickness foldable box blank and having a bottom, two upstanding end walls, two upstanding side walls, said side walls and end walls having upper edges which form a top edge of said box, and end flaps which are extensions of said side walls, each said side wall having a tab attached on said upper edge thereof which is downwardly folded on said attached side wall; and a unitary top rail extending around the top edge of said box, said top rail having a downwardly open channel formed between a pair of channel side walls, said channel being fitted over said upper edge of each said side wall, each said end wall, and each of said end flaps, said open channel having a width of approximately twice the thickness of said box blank so as to fit over one of said end walls and an adjacent said end flap on a first section of said top rail and one of said side walls and said attached downwardly folded tab on a second section of said top rail, said open channel having at least one inwardly extending hook on a bottom edge of at least one of said channel side walls, each said hook engaging one of said tabs and locking said top rail onto said top edge of said erected end and side walls.

10. A tote box of claim 9 wherein said foldable box blank is made of corrugated plastic sheet.

11. A tote box of claim 9 wherein said top rail is extruded from a material of at least one of a group consisting of plastic and aluminum.

12. A tote box of claim 9 wherein said top rail has a vertical lip on an outside upper edge thereof for facilitating stacking of a second tote box on top of said tote box.

13. A tote box of claim 9 further comprising:

hand holds which are received into holes into said erected end walls.

14. A tote box with self-locking top rail comprising:

a box formed from a uniform thickness foldable box blank and having a bottom, two upstanding end walls, two upstanding side walls, said side walls and end walls having upper edges which form a top edge of said box, and four end flaps which are extensions of said side walls, said side walls having tabs on said upper edges thereof which are downwardly folded on said side walls; and a unitary top rail extending around the top edge of said box, said top rail having a downwardly open channel formed between a pair of channel side walls, said channel being fitted over said upper edge of each said side wall, each said end wall, and each of said end flaps, said open channel having a width of approximately twice the thickness of said box blank so as to fit over said end wall and said end flaps and said side wall and said downwardly folded tabs, said open channel having at least one inwardly extending hook on a bottom edge of at least one of said channel side walls, each said hook engaging one of said tabs and locking said top rail onto said top edge of said erected end and side walls.

15. A tote box of claim 14 wherein said foldable box blank is made of corrugated plastic sheet.

16. A tote box of claim 14 wherein said top rail is extruded from a material of at least one of a group consisting of plastic and aluminum.

17. A tote box of claim 14 wherein said top rail has a vertical lip on an outside upper edge thereof for facilitating stacking of a second tote box on top of said tote box.

18. A tote box of claim 14 further comprising:

hand holds which are received into holes in said erected end walls.

19. A tote box with self-locking top rail comprising:

a box formed from a uniform thickness foldable box blank and having a bottom, two upstanding end walls, two upstanding side walls, said side walls and said end walls having upper edges which form a top edge of said box, said side walls and end walls having tabs attached on said upper edges thereof which are downwardly folded on said side walls and said end walls, respectively; and a unitary top rail extending around the top edge of said box, said top rail having a downwardly open channel formed between a pair of channel side walls, said channel being fitted over said upper edge of each said end wall and each said side wall, said open channel having a width of approximately twice the thickness of said box blank so as to fit over both of one of said side walls and said attached downwardly folded tab on a first section of said top rail, and both of one of said end walls and said attached downwardly folded tab on a second section of said top rail, said open channel having at least one inwardly extending hook on a bottom edge of at least one of said channel side walls, each said hook engaging one of said tabs and locking said top rail onto said top edge of said erected end and side walls.

20. A tote box of claim 19 wherein said foldable box blank is made of corrugated plastic sheet.

21. A tote box of claim 19 wherein said top rail is extruded from a material of at least one of a group consisting of plastic and aluminum.

22. A tote box of claim 19 wherein said top rail has a vertical lip on an outside upper edge thereof for facilitating stacking of a second tote box on top of said tote box.

23. A tote box of claim 19 further comprising:

hand holds which are received into holes in said erected end walls.

24. A tote box with self-locking top rail comprising:

a box formed from a uniform thickness foldable box blank and having a bottom, two upstanding end walls, two upstanding side walls, said side walls and end walls having upper edges which form a top edge of said box, and four end flaps which are extensions of said side walls, said end flaps being foldable about said end walls, each said side wall having a tab attached on said upper edges thereof which is downwardly folded on said attached side wall;

four corner enhancers, one of which resides in each inside corner of said box such that a first leg of each said corner enhancer is sandwiched between one of said end walls and an adjacent said end flap and a second leg of each said corner enhancer resides against an inside surface of said side wall from which said adjacent end flap extends; and a unitary top rail extending around the top edge of said box, said top rail having a downwardly open channel formed between a pair of channel side walls, said channel being fitted over said upper edge of each said side wall, each said end wall, and each of said end flaps, said open channel having a width of approximately twice the thickness of said box blank so as to fit over one of said end walls and an adjacent said end flap on a first section of said top rail and one of said side walls and said attached downwardly folded tab on a second section of said top rail, said open channel having at least one inwardly extending hook on a bottom edge of at least one of said channel side walls, each said hool engaging one of said tabs and locking said top rail onto said top edge of said erected end and side walls.

25. A tote box of claim 24 wherein said foldable box blank is made of corrugated plastic sheet.

26. A tote box of claim 24 wherein said corner enhancers and said top rail are each extruded from a material of at least one of a group consisting of plastic and aluminum.

27. A tote box of claim 24 wherein said top rail has a vertical lip on an outside upper edge thereof for facilitating stacking of a second tote box on top of said tote box.

28. A tote box of claim 24 further comprising:

hand holds which are received into holes in said erected end walls.

29. A tote box with self-locking top rail comprising:

a box formed from a uniform thickness foldable box blank and having a bottom, two upstanding end walls, two upstanding side walls, four end flaps which are extensions of said end walls, four side flaps which are extensions of said side walls, said side walls and said end walls having upper edges which form a top edge of said box, said side walls and end walls each having a tab attached on said upper edge thereof which is downwardly folded on said side wall and said end wall, respectively;

four corner angles, one of which is located at each corner of said box, each said corner angle having first and second open leg channels, each said leg channel being formed between a pair of leg channel side walls, said first leg channel being fitted onto a lateral edge of one of said side walls and said second leg channel being fitted onto said lateral edge of an adjacent said end wall, each said side wall lateral edge being formed by folding said side flap onto said side wall and each said end wall lateral edge being formed by folding said end flap onto said end wall, each said leg channel having a width of approximately twice the thickness of said box blank so that said first leg channel fits onto one of said side wall lateral edges and said second leg channel fits onto said adjacent end wall lateral edge, each of said second and first leg channels having an inwardly extending hook on an edge of at least one of asid leg channel side walls for engaging said end flap and said side flap, respectively, said corner angles erecting said end and side walls by having said one side wall lateral edge and said adjacent end wall lateral edge fitted within said first and second leg channels, respectively, to thereby maintain said one side wall and said adjacent end wall generally perpendicular to said bottom; and a unitary top rail extending around the top edge of said tote box, said top rail having a downwardly open channel formed between a pair of channel side walls, said channel being fitted over said upper edge of each said side wall and each said end wall, said open channel having a width of approximately twice the thickness of said box blank so as to fit over one of said side walls and said downwardly folded tab attached thereto on a first section of said top rail, and one of said end walls and said downwardly folded tab attached thereto on a second section of said top rail, said open channel having at least one inwardly extending hook on a bottom edge of at least one of said channel side walls, each said hook engaging one of said tabs and locking said top rail onto said top edge of said erected end and side walls.

30. A tote box of claim 29 wherein said foldable box blank is made of corrugated plastic sheet.

31. A tote box of claim 29 wherein said corner angles and said top rail are each extruded from a material of at least one of a group consisting of plastic and aluminum.

32. A tote box of claim 29 wherein said top rail has a vertical lip on an outside upper edge thereof for facilitating stacking of a second tote box on top of said tote box.

33. A tote box of claim 29 further comprising:

hand holds which are received into holes in said erected end walls.

34. A tote box with self-locking top rail comprising:

a box formed from a uniform thickness foldable box blank and having a bottom, two upstanding end walls, two upstanding side walls, four end flaps which are extensions of said end walls, four side flaps which are extensions of said side walls, said side walls having upper edges which form a top edge of said box, said side walls and end walls each having a tab attached on said upper edge thereof which is downwardly folded on said side wall;

four corner angles, one of which is located at each corner of said box, each said corner angle having first and second open leg channels, each said leg channel being formed between a pair of leg channel side walls, said first leg channel being fitted onto a lateral edge of one of said side walls and said second leg channel being fitted onto said lateral edge of an adjacent said end wall, each said side wall lateral edge being formed by folding said side flap onto said side wall and each said end wall lateral edge being formed by folding said end flap onto said end wall, each said leg channel having a width of approximately twice the thickness of said box blank so that said first leg channel fits onto one of said side wall lateral edges and said second leg channel fits onto said adjacent end wall lateral edge, each of said second and first leg channels having an inwardly extending hook on an edge of at least one of said leg channel side walls for engaging said end flap and said side flap, respectively, said corner angles erecting said end and side walls by having said one side wall lateral edge and said adjacent end wall lateral edge fitted within said first and second leg channels, respectively, to thereby maintain said one side wall and said adjacent end wall generally perpendicular to said bottom; and at least two sections of top rail positioned on the top edge of said tote box, each said top rail section having a downwardly open channel formed between a pair of channel side walls, each said channel being fitted over said upper edge of one of said side walls, said open channel having a width of approximately twice the thickness of said box blank so as to fit over one of said side walls and said downwardly folded tab attached thereto, said open channel having at least one inwardly extending hook on a bottom edge of at least one of said channel side walls, each said hook engaging one of said tabs and locking said top rail onto said top edge of said erected side wall.

* * * * *

US005295632B1

REEXAMINATION CERTIFICATE (3499th)

United States Patent [19] [11] B1 5,295,632

Zink et al. [45] Certificate Issued Apr. 21, 1998

[54] TOTE BOX WITH SELF LOCKING TOP RAIL

[75] Inventors: Robert M. Zink, Grand Haven; Judson A. Bradford, Holland; Donald J. Bazany, Grand Haven, all of Mich.

[73] Assignee: Bradford Company, Holland, Mich.

Reexamination Request:
No. 90/004,703, Jul. 25, 1997

Reexamination Certificate for:

| | |
|---|---|
| Patent No.: | **5,295,632** |
| Issued: | **Mar. 22, 1994** |
| Appl. No.: | **992,562** |
| Filed: | **Dec. 18, 1992** |

[51] Int. Cl.[6] ..... B65D 5/44

[52] U.S. Cl. ..... 229/198; 229/117.16; 229/198.1; 229/199; 229/918; 229/919

[58] Field of Search ..... 229/117.16, 117.17

[56] References Cited

U.S. PATENT DOCUMENTS

| | | | |
|---|---|---|---|
| 1,241,633 | 10/1917 | Johnson . | |
| 1,682,028 | 8/1928 | Young . | |
| 2,191,291 | 2/1940 | Smith . | |
| 2,225,958 | 12/1940 | Mandel | 229/915 |
| 2,232,037 | 2/1941 | Powell . | |
| 2,304,853 | 12/1942 | Shaw . | |
| 2,347,725 | 5/1944 | Zalkind . | |
| 2,544,283 | 3/1951 | Snyder . | |
| 2,941,710 | 6/1960 | Smith et al. | 229/199 |
| 2,947,462 | 8/1960 | Bostock . | |
| 2,954,914 | 10/1960 | Herlihy | 229/199 |
| 2,961,139 | 11/1960 | Nobili | 229/918 |
| 3,226,008 | 12/1965 | Chiorri | 229/198 |
| 3,331,527 | 7/1967 | Kaas et al. . | |
| 3,512,696 | 5/1970 | Ebert . | |
| 3,622,037 | 11/1971 | Gildart . | |
| 3,647,101 | 3/1972 | Hensch et al. . | |
| 3,659,774 | 5/1972 | Mielke . | |
| 3,687,168 | 8/1972 | Sherman et al. . | |
| 3,797,727 | 3/1974 | Downing et al. . | |
| 4,068,794 | 1/1978 | Lawrence | 229/915 |
| 4,095,719 | 6/1978 | Wolf . | |
| 4,172,623 | 10/1979 | Anderson . | |
| 4,210,274 | 7/1980 | Leonard | 229/918 |
| 4,503,973 | 3/1985 | Andersson . | |
| 4,572,368 | 2/1986 | Miller et al. . | |
| 4,619,371 | 10/1986 | Rehrig . | |
| 4,624,380 | 11/1986 | Wernette . | |
| 4,693,387 | 9/1987 | Stonier . | |
| 4,787,515 | 11/1988 | Stoll | 206/509 |
| 4,848,580 | 7/1989 | Wise . | |
| 4,971,201 | 11/1990 | Sathre . | |
| 5,033,669 | 7/1991 | Federico . | |
| 5,037,027 | 8/1991 | Nichols . | |
| 5,074,461 | 12/1991 | Parker et al. | 229/117.16 |

FOREIGN PATENT DOCUMENTS

| | | | |
|---|---|---|---|
| 1321584 | 2/1962 | France . | |
| 53167 | 9/1942 | Netherlands | 229/DIG. 11 |
| 6612391 | 3/1968 | Netherlands . | |
| 1007046 | 10/1965 | United Kingdom | 229/117.16 |

OTHER PUBLICATIONS

The Wiley Encyclopedia of Packaging Technology, John Wiley & Sons, pp. 226–228, 1968.

*Primary Examiner*—Gary E. Elkins

[57] ABSTRACT

An improved tote box construction is disclosed which incorporates a unitary top rail which can be secured along the top edge of the erected walls of the tote box without the benefit of any mechanical fasteners such as rivets or the like. The unitary top rail is secured onto the tote box by a hook on the bottom edge of a channel side wall which engages downwardly folded tabs on the top edge of the walls of the tote box. The unitary top rail has a vertical lip which facilitates the stacking of multiple tote boxes according to the present invention.

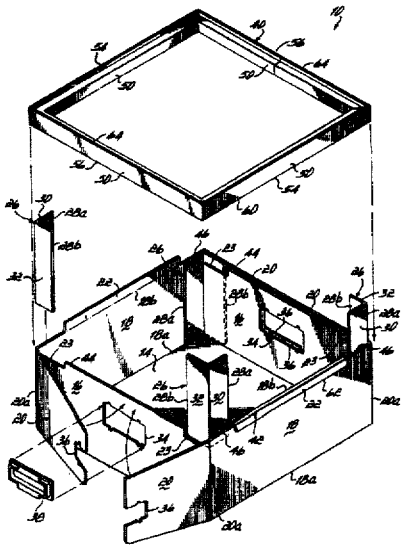

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 24–34 is confirmed.

Claims 2, 7 and 9–18 are cancelled.

Claims 1, 3, 5 and 19 are determined to be patentable as amended.

Claims 4, 6, 8 and 20–23, dependent on an amended claim, are determined to be patentable.

New claim 35 is added and determined to be patentable.

1. A tote box with self-locking top rail comprising:

a box formed from a uniform thickness foldable box blank and having a bottom, two upstanding end walls, two upstanding side walls, and four end flaps which are extensions of said side walls, said side walls and end walls having upper edges which form a top edge of said box, said side walls having tabs on said upper edges thereof which are downwardly folded on said side walls; [and]

a unitary top rail extending around the top edge of said box, said top rail having a downwardly open channel formed between a pair of channel side walls, said channel being fitted over said upper edge of each said side wall, each said end wall, and each of said end flaps, said open channel having a width of approximately twice the thickness of said box blank so as to fit over said end walls and said end flaps and said side walls and said downwardly folded tabs, said open channel having at least one inwardly extending hook on a bottom edge of at least one of said channel side walls, each said hook engaging one of said tabs and locking said top rail onto said top edge of said erected end and side walls[.]; *and*

*four corner enhancers, one of which resides in each inside corner of said box such that a first leg of each said corner enhancer is sandwiched between each said end wall and said end flaps and a second leg of each said corner enhancer resides against an inside surface of said side wall.*

3. A tote box [of claim 1 further comprising:] *with self-locking top rail comprising:*

*a box formed from a uniform thickness foldable box blank and having a bottom, two upstanding end walls, two upstanding side walls, and four end flaps which are extensions of said side walls, said side walls and end walls having upper edges which form a top edge of said box, said side walls having tabs on said upper edges thereof which are downwardly folded on said side walls;*

*a unitary top rail extending around the top edge of said box, said top rail having a downwardly open channel formed between a pair of channel side walls, said channel being fitted over said upper edge of each said side wall, each said end wall, and each of said end flaps, said open channel having a width of approximately twice the thickness of said box blank so as to fit over said end walls and said end flaps and said side walls and said downwardly folded tabs, said open channel having at least one inwardly extending hook on a bottom edge of at least one of said channel side walls, each said hook engaging one of said tabs and locking said top rail onto said top edge of said erected end and side walls;* four side flaps which are extensions of said end walls, each said side flap being attached to a lateral edge of one of said end walls; and four corner angles, one of which is located at each corner of said box, each said corner angle having first and second open leg channels formed between a pair of leg channel side walls, said first leg channel being fitted onto a lateral edge of one of said side walls and said second leg channel being fitted onto said lateral edge of an adjacent said end wall, each said side wall lateral edge being formed by folding said side flap onto said end wall and each said end wall lateral edge being formed by folding said end flap onto said side wall, each said leg channel having a width of approximately twice the thickness of said box blank so that said first leg channel fits onto one of said side wall lateral edges and said second leg channel fits onto said adjacent end wall later edge, each of said second and first leg channels having an inwardly extending hook on an edge of at least one of said leg channel side walls for engaging said end flap and said side flap, respectively, said corner angles erecting said end and side walls by having said one side wall lateral edge and said adjacent end wall lateral edge fitted within said first and second leg channels, respectively, to thereby maintain said one side wall and said adjacent end wall generally perpendicular to said bottom.

5. A tote box of claim [2] *1* wherein said corner enhancers and said top rail are each extruded from a material of at least one of a group consisting of plastic and aluminum.

19. A tote box with self-locking top rail comprising:

a box formed from a uniform thickness foldable box blank and having a bottom, two upstanding end walls, two upstanding side walls, said side walls and said end walls having upper edges which form a top edge of said box, said side walls and end walls having tabs attached on said upper edges thereof which are downwardly folded on said side walls and side end walls, respectively; and a unitary top rail extending around the top edge of said box, said top rail having a downwardly open channel formed between a pair of channel side walls, said channel being fitted over said upper edge of each said end wall and each said side wall, said open channel having a width of approximately twice the thickness of said box blank so as to fit over both of one of said side walls and said attached downwardly folded tab on a first section of said top rail, and both of one of said end walls and said attached downwardly folded tab on a second section of said top rail, said open channel having at least one inwardly extending hook on a bottom edge of at least one of said channel side walls, each said hook engaging one of said tabs and locking said top rail onto said top edge of said erected end and side walls[.], *said foldable box blank being made of corrugated plastic sheet; and top rail being extruded*

*from a material of at least one of a group consisting of plastic and aluminum.*

*35. The tote box according to any one of claims 1, 3–6, 8, and 19–34 wherein said top rail has right angle corners formed by removing corner notches at each of said corners and folding said rail 90 degrees at each notch.*

* * * * *